United States Patent [19]

Piotrowski et al.

[11] 4,425,248

[45] Jan. 10, 1984

[54] WATER SOLUBLE LUBRICANT COMPOSITIONS

[75] Inventors: Alfred B. Piotrowski, Woodbury; Robert H. Davis, Pitman, both of N.J.

[73] Assignee: Mobil Oil Corporation, New York, N.Y.

[21] Appl. No.: 332,136

[22] Filed: Dec. 18, 1981

[51] Int. Cl.[3] ..... C10M 3/30

[52] U.S. Cl. ..... 252/49.3; 252/49.5; 252/51.5 A

[58] Field of Search ..... 252/49.3, 49.5, 51.5 A, 252/34, 34.7, 560

[56] References Cited

U.S. PATENT DOCUMENTS

| | | | |
|---|---|---|---|
| 2,939,842 | 6/1960 | Thompson | 252/34 X |
| 2,959,547 | 11/1960 | Brillhart | 252/49.3 X |
| 3,256,187 | 6/1966 | Davis | 252/34.7 X |
| 3,269,946 | 8/1966 | Wiese | 252/51.5 A X |
| 3,374,171 | 3/1968 | Davis | 252/49.3 X |
| 4,053,426 | 10/1977 | Davis et al. | 252/49.3 X |
| 4,289,636 | 9/1981 | Davis et al. | 252/49.3 |

*Primary Examiner*—Andrew Metz

*Attorney, Agent, or Firm*—Alexander J. McKillop; Michael G. Gilman; Claude E. Setliff

[57] ABSTRACT

Water soluble lubricant compositions comprising alkanolamine and organic acid are improved by employing as the organic acid a partial acid amide of a dicarboxylic acid, such as mono-PRIMENE 81 R amide of succinic acid, mono-di-2-ethylhexylamide of maleic acid, mono-di-2-ethylhexylamide of methyltetrahydrophthalic acid and mono-di-2-ethylhexylamide of methylhexahydrophthalic acid as the organic acid.

17 Claims, No Drawings

WATER SOLUBLE LUBRICANT COMPOSITIONS

BACKGROUND OF THE INVENTION

1. Field of the Invention

This present invention relates to lubricant compositions and more particularly to water-soluble lubricant compositions adapted for use as lubricants and coolants in metal machining operations.

2. Description of the Prior Art

In machining operations of metals, such as cutting, grinding, turning, milling and the like, it is customary to flood the tool and the work with a coolant for the purpose of carrying off heat which is produced during the operation. It is also customary to employ these coolants in combination with various agents having lubricating and extreme-pressure properties for reducing friction between the tool and work piece, particularly in operations such as tapping and broaching. In this respect, it has, heretofore, been the practice to employ for such purpose aqueous compositions containing such lubricating agents as emulsified petroleum or non-petroleum additives. Such aqueous cutting fluids, in order to perform satisfactorily, should meet certain important requirements.

Among the requirements for a satisfactory cutting fluid are corrosion-inhibiting properties for ferrous and cuprous alloys, and also stability under the conditions of operation. While various cutting fluids may possess such characteristics, there are, however, further important requirements that should also be met. Among these requirements is the ability to avoid leaving deposits on the tool and the work following the machining operation which result from subsequent drying of the fluid and which are difficult to remove. Other important requirements include tolerance in hard water solutions so that the precipitation of lubricant components will not occur, avoidance of tacky residues which interfere with the operation of the machine and avoidance of excessive foam formation. Cutting fluids known prior to this invention have not, however, satisfactorily met all of the foregoing requirements.

U.S. Pat. No. 3,374,171 teaches lubricants for metal working that contain alkanolamine polyoxyalkylene glycol and a saturated organic acid having 6 to 9 carbon atoms.

SUMMARY OF THE INVENTION

In accordance with the invention, there is provided an improved water-soluble lubricant, said lubricant comprising an alkanolamine and an organic acid, the improvement wherein the organic acid is an organic acid partial amide. More particularly, the organic acid amide may be a hydrocarbyl substituted partial amide of a dicarboxylic acid. Organic acids which are suitable for employment in the formulations of the present invention include mono-PRIMENE 81 R amide of succinic acid, mono-di-2-ethylhexylamide of maleic acid, mono-di-2-ethylhexylamide of methyltetrahydrophthalic acid and mono-di-2-ethylhexylamide of methylhexahydrophthalic acid.

DESCRIPTION OF SPECIFIC EMBODIMENTS

The advantages of the improved lubricants are realized with aqueous compositions comprising a major proportion of water and, in individual minor proportions, a water-soluble alkanolamine and a water-soluble polyoxyalkylene glycol. In this respect, it is found that the alkanolamine component, in addition to functioning as a corrosion-inhibiting agent in which the aformentioned organic acids are soluble, also functions as a plasticizer in that, in the course of use, evaporation of water from the cutting fluid leaves a residue upon machinery parts which is desirably soft or semi-liquid. The function of the organic acid component in combination with the alkanolamine is primarily that of a corrosion inhibitor in that it forms the corresponding amine acid salt.

The water-soluble alkanolamine employed in the novel formulation may be of any molecular weight but should, preferably, be liquid at room temperature. The lower molecular weight compounds are generally preferred and, for this purpose, it has been found that such alkanolamines as mono-, di- or triethanolamine are most effective. Other water-soluble alkanolamines may also be employed, and include such alkanolamine as isopropanolamines, e.g., mono-, di- and triisopropanolamine, dimethylethanolamine, diethylethanolamine, aminoethylethanolamine, N-acetylethanolamine, phenylethanolamine, phenyldiethanolamine and mixtures thereof.

The organic acid employed is a partial amide of a dicarboxylic acid, such as, for example, maleic acid or succinic acid or maybe the partial amide of an alkyl substituted tetrahydro- or hexahydrothalic acid-amide.

The lubricant will normally contain a load support agent. Included among such agents are the polyoxyalkylene glycols (also referred to as polyalkylene glycols). The preferred members include water-soluble oils obtained by copolymerizing mixtures of ethylene oxide and propylene oxide, e.g., oils prepared by copolymerizing a 50—50 mixture of ethylene oxide and propylene oxide; water-soluble heteric copolymeric alkylene glycols, ethers or esters thereof, wherein the different oxylalkylene units are substantially randomly distributed throughout the entire polyoxyalkylene chain; water soluble polyoxyalkylene compounds containing hydrophobic homopolyoxyalkylene units; and polymeric agents in general, which are block copolymers of cogeneric mixtures of conjugated polyoxyalkylene compounds containing at least one hydrophobic homopolyoxyalkylene unit, having a unit weight of at least about 800, and one or two other hydrophilic polymeric units which comprise from about 15 percent to about 90 percent of the total polymeric compound. The most desirable watersoluble polyoxyalkylene glycols for use in the formulations of the present invention comprise the polyether polyols produced by reacting ethylene oxide and propylene oxide having hydroxyl numbers from about 22 to about 38. If so desired, in order to impart increased anti-rust properties to the aqueous lubricant composition, an alkali metal nitrite may also be employed in the novel formulation. In this respect, it is found that more specific increased resistance to copper corrosion may also be obtained by the additional use of the sodium salt of mercaptobenzothiazole, benzotriazole or tolutriazole.

The aforementioned novel formulations of water-soluble alkanolamine, organic acid and water-soluble polyoxyalkylene glycol may also include a wide variety of germicidal agents for inhibiting bacterial growth. For this purpose, the germicidal agent may comprise, for example, a halogenated cresol, either completely or partially halogenated cresol, and may include such representative compounds as completely or partially chlorinated, brominated, fluorinated or iodated cresols. Typical examples of this class of materials include: chloro-, dichloro-, trichloro- and tetrachlorocresols; bromo-, dibromo-, tribromo, and tertrabromocresols, or any of the aforementioned compounds in which the chlorine or bromine atoms are substituted in whole or in part by fluorine or iodine. More specific compounds include: para-chloro-meta-cresol; para-bromo-meta-cresol; para-fluoro-meta-cresol; 2,4-dibromo-meta-cresol; 2,4,5-trichloro-meta-cresol; 2,4,5,6-tetrachloro-meta-cresol; 2,4-dibromo-meta-cresol; 2,4,5-tribromo-meta-cresol; 2,4,5,6-tetrabromo-meta-cresol; or any of the aforementioned compounds in which the chlorine or bromine atoms are substituted in whole or in part by fluorine or iodine; or any corresponding ortho or para- cresols of the aforementioned compounds substituted for the corresponding meta-cresols.

Other germicidal agents that may be employed in the above-described novel formulations may include aldehydes, such as formaldehyde, or aldehyde-releasing agents such as formaldehyde-releasing agents, i.e., materials which break down in storage to form the aldehyde or aldehyde compounds as decomposition products. Thus, it is found that compounds such as tris(hydroxymethyl) nitromethane are particularly effective in releasing formaldehyde and thereby providing germicidal protection over relatively long periods of time. Other microbicidal gases that may be employed for this purpose include ethylene oxide and beta propiolactone. Alcohols such as methyl alcohol, ethyl alcohol or higher alcohols may also be employed as germicidal agents. Other effective germicidal agents include halogens and halogens compounds, particularly iodine and chlorine and compounds of these halogens. Specific compounds of this type may include chloride of lime and iodophors. Furthermore, as germicidal agents, compounds of heavy metals may include such compounds as bichloride of mercury and organic mecurials such as Mercurochrome (trademark for merbromin), Menthiolate (trademark for thimerosal), Metaphen (trademark for $CH_3C_6H_2ONO_2Hg$), silver nitrate and copper sulfate. Germicidal agents comprising phenol and its derivatives may also be employed in the novel formulations, which include the aforementioned cresols and bis-phenols. Synthetic detergents may also be employed as germicidal agents, which are of the non-phenolic type. These may include, for example, ammonium halides, such as ammonium chloride, in which the hydrogen atoms have been replaced by organic radicals; particularly effective are quaternary compounds in which the long-chain organic radical (alkyl group) contains from 12 to 16 carbon atoms. Other materials include quaternary compounds in which the organic group is an anion, e.g., sodium laurylsulfate, as well as those compounds which do not ionize.

The novel lubricant compositions of the present invention, as previously indicated, are formulated in accordance with certain balanced proportions expressed in weight percent. The alkanolamine is employed in an amount from about 5 to about 50 percent, and preferably in an amount from about 20 to about 40 percent, by weight. The organic acid component is employed in an amount from about 1 to about 30 percent, and preferably in an amount from about 10 to about 25 percent, by weight. The polyoxyalkylene glycol is employed in an amount from about 0.5 to about 20 percent, and preferably in an amount from about 0.5 to about 3 percent, by weight. Where a germicidal agent is also to be incorporated in the novel formulation, these agents are employed in an amount from about 0.05 to about 5 percent, and preferably in an amount from about 0.5 to about 3 percent, by weight. When the alkali metal nitrite is to be included in the formulation, it is generally employed in an amount from about 0.1 to about 10 percent, and preferably in an amount from about 0.1 to about 5 percent, by weight. When benzotriazole is to be included in the formulation, it is generally present in an amount from about 0.1 to about 5 percent, and preferably from about 0.1 to about 2 percent, by weight. If so desired, other additives for enhancing rust protection or for the purpose of changing the pH of the system may be employed. Such additional additives may include boric acid, borate esters or oxides of boron for enhancing rust protection, and are generally employed in an amount from about 0.1 to about 5 percent, and preferably from about 0.1 to about 3 percent, by weight. For raising the pH of the system, such additional additives may be employed in the form of alkali metal hydroxides, including more specifically, sodium, lithium or potassium hydroxide. When the latter are present, they are generally employed in an amount from amount 0.1 to about 3 percent, and preferably from about 0.1 to about 1.5 percent, by weight. Furthermore, if so desired, various water-soluble chelating agents may be employed to soften the water vehicle. These may include, for example, salts of ethylenediamine tetraacetic acid, nitrilo-triacetic acid or diethylene triamine pentaacetic acid. When any of the aforementioned chelating agents are employed, they are generally present in an amount from about 0.1 to about 5 percent, by weight. In each instance, of course, it will be apparent that sufficient water is employed in order to balance the formulation.

The novel lubricant compositions of the present invention are preferably prepared by a blending procedure which comprises mixing the alkanolamine and organic acid amide components with about 10 to about 20 parts of water, which is to be present in the finished formulation. This blending procedure may be carried out at room temperature. However, heating to 120° F. with agitation is most satisfactory. The remaining quantity of water required to be present in the finished product is added, together with the polyoxyalkylene glycol, and any of the aforementioned other desired components. It should be noted, however, that if an alkali metal nitrite is to be present in the finished product, such material is added last for the reason that addition of acids such as caprylic acid to a solution of sodium nitrite could result in decomposition of the nitrite, thus reducing or nullifying its rust-inhibiting effects. If a germicidal agent is to be incorporated in the novel formulation, it is preferably blended with the alkanolamine and organic acid.

The compounding of the novel compositions of the present invention may be illustrated by the preparation of lubricant and cutting fluids from the formulations in the following table and examples and which also include comparative data. They were tested in a corrosion test, as follows:

Corrosion Test

One to three grams of malleable iron chips are placed on a filter paper in a glass petri dish, 10 grams of test fluid which is to be evaluated is placed on the chips and allowed to stand at a temperature of about 70° F. for a period of about 24 hours. After this period the sample is then checked for the appearance of rust. In the data presented in the following table, R designates rusting of the sample iron chips while N.R. signifies no rust.

EXAMPLE 1

Mono-Primene 81 R Amide of Succinic Acid

One mole (100.0 g) of succinic anhydride and one mole (195.0 g) of PRIMENE-81 R* were heated gradually to 150° C., and held at that temperature for 3–4 hours. This product was then screened as an anti-rust additive.

*PRIMENE-81 R is a tradename of the Rohm and Haas Company for a mixture of t-alkyl primary amines comprising from about $C_{12}H_{25}NH_2$ up to about $C_{14}H_{29}NH_2$ having a molecular weight of about 192.0.

EXAMPLE 2

Mono-Di-2-Ethylhexylamide of Maleic Acid

One mole (98.0 g) of maleic anhydride and one mole (241.5 g) of di-2-ethylhexylamine were heated gradually to 135° C. and held at that temperature for 3–4 hours. This product was screened as an anti-rust agent.

EXAMPLE 3

Mono-Di-2-Ethylhexylamide of Methyltetrahydrophthalic Acid

Eighty-three grams (0.5 mole) of methyl-cis-1,2,3,6-tetrahydrophthalic anhydride and 120.75 g (0.5 mole) of di-2-ethylhexylamine were gradually heated to 135° C., and held at that temperature for 3–4 hours. The reaction product was then screened as an anti-rust agent.

EXAMPLE 4

Mono-Di-2-Ethylhexylamide of Methyl Hexahydrophthalic Acid

Eighty-four grams (0.5 mole) of methyl hexahydrophthalic anhydride and 120.75 g (0.5 mole) of di-2-ethylhexylamine were heated gradually to 135° C. and held at that temperature for 3–4 hours. The reaction product was then screened as an anti-rust agent.

TABLE 1

| | Lubricant Composition | | | | | | | | Malleable Iron Rust Test - Dilutions in Distilled Water** | | |
|---|---|---|---|---|---|---|---|---|---|---|---|
| | | | | | | | Lubricant Composition | | | | |
| Example | DEA (1) Wt. % | TEA (2) Wt. % | Example 1 (3) | Example 2 (4) | Example 3 (5) | Example 4 (6) | Glycol,* Wt. % | Water, Wt. % | 60:1 | 90:1 | 120:1 |
| 1 | 18.5 | 20.5 | 22.0 | — | — | — | 15.0 | 21.85 | NR | R | R |
| 2 | 18.5 | 20.5 | — | 22.0 | — | — | 15.0 | 21.85 | NR | R | R |
| 3 | 18.5 | 20.5 | — | — | 22.0 | — | 15.0 | 21.85 | NR | NR | R |
| 4 | 18.5 | 20.5 | — | — | — | 22.0 | 15.0 | 21.85 | NR | NR | R |

(1) — Diethanolamine
(2) — Triethanolamine
(3) — Mono-Primene 81 R Amide of Succinic Acid
(4) — Mono-Di-Ethylhexylamide of Maleic Acid
(5) — Mono-Di-2-Ethylhexylamide of Methyltetrahydrophthalic Acid
(6) — Mono-Di-2-Ethylhexylamide of Methyl Hexahydrophthalic Acid
* = Diethylene glycol.
** = Parts of composition to parts of distilled water.
NOTE
0.25% by weight tolutriazole was used as a metal deactivator and 1.9% by weight ethylene oxide, propylene oxide copolymer was used as an anti-wear agent in each of the above examples.

We claim:

1. A water soluble lubricant composition comprising from about 5% to about 50% by weight of an alkanolamine, from about 1% to about 30% by weight of a partial acid amide of a succinic acid, maleic acid, a methyltetrahydrophthalic acid or a methylhexahydrophthalic acid and from about 0.5% to about 20% by weight of a polyalkylene glycol.

2. The lubricant of claim 1 wherein the partial amide is a $C_{12}$ to $C_{14}$ alkyl amide of succinic acid.

3. The lubricant of claim 1 wherein the partial amide is the mono-di-2-ethylhexylamide of maleic acid.

4. The lubricant of claim 1 wherein the partial amide is the mono-di-2-ethylhexylamide of methyltetrahydrophthalic acid.

5. The lubricant of claim 1 wherein the partial amide is the mono-di-2-ethylhexylamide of methylhexahydrophthalic acid.

6. The lubricant of claim 1 wherein the glycol is a copolymer of ethylene and propylene oxides.

7. The lubricant of claim 1 wherein the alkanolamine is diethanolamine.

8. The lubricant of claim 1 wherein the alkanolamine is triethanolamine.

9. The composition of claim 1 additionally containing from about 0.5% to about 5% by weight of a germicidal agent.

10. The composition of claim 9 wherein the germicidal agent is a halogenated cresol.

11. The composition of claim 10 wherein the halogenated cresol is para-chloro-meta-cresol, para-bromo-meta-cresol, para-fluoro-meta-cresol, 2,4-dibromo-, 2,4,5-tribromo- or 2,4,5,6-tetrabromo-meta-cresol.

12. The composition of claim 9 wherein the germicidal agent is an aldehyde.

13. The composition of claim 12 wherein the aldehyde is formaldehyde or formaldehyde-releasing agents.

14. The composition of claim 13 wherein the formaldehyde is obtained by release from tris(hydroxymethyl) nitromethane.

15. The composition of claim 9 wherein the germicidal agent is an alcohol.

16. The composition of claim 9 wherein the germicidal agent is bichloride of mecury, Mercurochrome, Menthiolate, Metophen, silver nitrate, copper sulfate or an ammonium halide.

17. The composition of claim 1 containing 10 to 20 parts by weight of water.

* * * * *